US010938188B2

(12) United States Patent
Lin et al.

(10) Patent No.: US 10,938,188 B2
(45) Date of Patent: Mar. 2, 2021

(54) ION WIND GENERATING DEVICE

(71) Applicant: Igistec Co., Ltd., Hsinchu County (TW)

(72) Inventors: Yu-Hsuan Lin, Hsinchu County (TW); Chung-Yi Wang, Hsinchu County (TW)

( * ) Notice: Subject to any disclaimer, the term of this patent is extended or adjusted under 35 U.S.C. 154(b) by 225 days.

(21) Appl. No.: 16/372,493

(22) Filed: Apr. 2, 2019

(65) Prior Publication Data

US 2019/0305524 A1 Oct. 3, 2019

Related U.S. Application Data

(60) Provisional application No. 62/651,708, filed on Apr. 2, 2018.

(51) Int. Cl.
*H01T 19/00* (2006.01)
*H01T 19/04* (2006.01)
*H01T 23/00* (2006.01)

(52) U.S. Cl.
CPC ..... *H01T 23/00* (2013.01); *H01T 19/00* (2013.01); *H01T 19/04* (2013.01)

(58) Field of Classification Search
CPC ..... H01T 19/00; H01T 19/02; H01T 19/04; H01T 23/00
USPC ..... 361/230, 231, 233, 234
See application file for complete search history.

(56) References Cited

U.S. PATENT DOCUMENTS 3,422,263 A * 1/1969 Asahina ..... H01T 23/00 361/231
3,582,711 A * 6/1971 Jahnke ..... A61N 1/44 361/231
4,231,331 A * 11/1980 Suzuki ..... H01T 19/04 123/406.48
6,312,507 B1 * 11/2001 Taylor ..... A01K 1/0107 119/165
7,452,411 B2 * 11/2008 Volodina ..... B03C 3/51 96/66
8,355,238 B2 * 1/2013 Lee ..... H01T 23/00 361/231
2003/0098650 A1 * 5/2003 Adachi ..... H01T 23/00 313/587
2006/0232908 A1 * 10/2006 Izumi ..... H01T 23/00 361/220
2008/0158768 A1 * 7/2008 Yamashita ..... H01T 23/00 361/230

(Continued)

*Primary Examiner* — Thienvu V Tran
*Assistant Examiner* — Ivan Laboy

(57) ABSTRACT

An ion wind generating device includes a high voltage power supply, a capacitor connected in parallel to the high voltage power supply, a first metal cone connected in series to the high voltage power supply, a ground plate disposed on the same axis as the first metal cone, a starter motor, and a second metal cone disposed on a connecting shaft. The starter motor includes a rotating shaft and a connecting shaft perpendicular to the rotating shaft. After second metal cone moves to be located between first cone and the ground plate, the starter motor stops rotating. The high voltage power supply charges the capacitor with the high voltage power, and the capacitor discharges the first metal cone. When the second metal cone is located between the first metal cone and the ground plate, the first metal cone causes the second metal cone to discharge to generate an ionic wind.

9 Claims, 3 Drawing Sheets

(56) References Cited

U.S. PATENT DOCUMENTS

| | | | | |
|---|---|---|---|---|
| 2010/0001205 | A1* | 1/2010 | Sekoguchi | H01T 23/00 250/423 R |
| 2011/0255206 | A1* | 10/2011 | Riskin | H01T 23/00 361/230 |
| 2012/0162851 | A1* | 6/2012 | Sato | H01T 23/00 361/231 |
| 2014/0239837 | A1* | 8/2014 | Date | H01T 23/00 315/219 |
| 2018/0204710 | A1* | 7/2018 | Maeda | F03G 7/06 |
| 2018/0262052 | A1* | 9/2018 | Corum | H01T 19/02 |
| 2018/0262054 | A1* | 9/2018 | Corum | H01Q 1/1242 |
| 2019/0242409 | A1* | 8/2019 | Newberry | F04F 99/00 |

* cited by examiner

ION WIND GENERATING DEVICE

BACKGROUND OF THE INVENTION

Field of the Disclosure

The present disclosure relates to a wind generating device, and more particularly to an ion wind generating device.

Description of Related Art

Ionic wind is one of the means of producing fanless wind. When the DC voltage is turned on, negative ions will deviate from the orbit, and will be attracted and neutralized by the positive discharge electrode under the action of a strong electric field. The remaining positive ions continue to hit the air, and more positive ions are produced. During the procedure of exchanging electrodes of positive ions and negative ions, the air is drawn to flow.

Because the ion wind generating device is small in size and noise-free, its wind speed is superior to that of traditional small-sized mechanical fans. In the early days, it was mostly used for cooling electronic components. It can be seen on electronic devices such as notebook computers that strive to be miniaturized. As technology advances, the ion wind generating device begins to act as a power device, which functions as a power source to drive certain devices to move.

In view of this, how to design an ion wind generating device that can be used for a small-sized lifting device instead of a conventional motor and a complicated mechanism driving method is worthy of consideration by those who have ordinary knowledge in the field.

SUMMARY OF THE INVENTION

To achieve the foregoing and other aspects, an ion wind generating device is provided. The ion wind generating device includes a high voltage power supply, a capacitor connected in parallel to the high voltage power supply, a first metal cone connected in series to the high voltage power supply, a ground plate disposed on the same axis as the first metal cone, a starter motor, and a second metal cone disposed on a connecting shaft. The starter motor includes a rotating shaft and a connecting shaft perpendicular to the rotating shaft. After second metal cone moves to be located between first cone and the ground plate, the starter motor stops rotating. The high voltage power supply charges the capacitor with the high voltage power, and the capacitor discharges the first metal cone. When the second metal cone is located between the first metal cone and the ground plate, the first metal cone causes the second metal cone to discharge to generate an ionic wind.

In the ion wind generating device, wherein the ion wind generating device further comprises a diode. The diode is disposed between the first metal cone and the high voltage power supply.

In the ion wind generating device, wherein the high voltage power supply is a high voltage coil.

In the ion wind generating device, wherein the ion wind generating device further comprises an electric generator. The electric generator is coupled to the rotating shaft of the starter motor.

In the ion wind generating device, wherein the ion wind generating device further comprises a low voltage end. The low voltage end is disposed behind the ground plate.

In the ion wind generating device, wherein the voltage values of the high voltage power supply, the ground plate and the low voltage end are arranged in descending order.

In the ion wind generating device, wherein the ion wind generating device further comprises a switch. The switch is connected in series to the high voltage power supply, wherein the high voltage power supply supplies the periodic high voltage power through the switch.

In the ion wind generating device, wherein the ion wind generating device further comprises a diode. The diode is connected in series to the high voltage power supply.

In the ion wind generating device, wherein the high voltage power supply supplies the periodic high voltage power by using pulse control.

DESCRIPTION OF THE INVENTION

Figure 1:
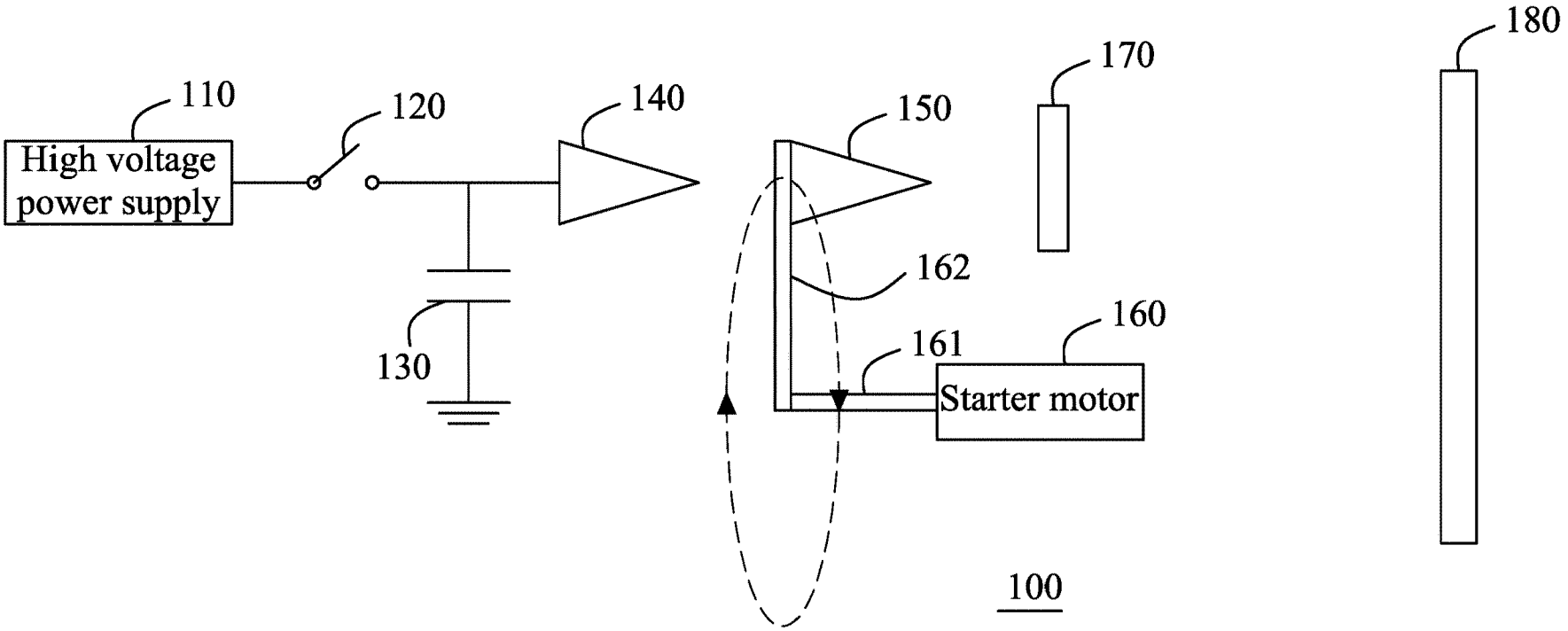
FIG. 1 is a schematic diagram of an ion wind generating device according to a first embodiment of the present invention.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Please refer to FIG. 1. FIG. 1 is a schematic diagram of an ion wind generating device according to a first embodiment of the present invention. In this embodiment, the ion wind generating device 100 includes, but is not limited to, a high voltage power supply 110, a switch 120, a capacitor 130, a first metal cone 140, a ground plate 170, a starter motor 160, a second metal cone 150 and a low voltage end 180. The high voltage power supply 110 is adapted to provide a high voltage power and control the voltage output of the high voltage power supply 110 via the switch 120. The switch 120 is connected in series to the high voltage power supply 110, the capacitor 130 is connected in parallel to the switch 120, and the first metal cone 140 is connected in series to the switch 120 and the high voltage power supply 110.

The ground plate 170 is disposed on the same axis as the first metal cone 140, and there is a certain distance existed between the ground plate 170 and the first metal cone 140. The starter motor 160 includes a rotating shaft 161 and a connecting shaft 162, wherein the connecting shaft 162 is perpendicularly disposed on the rotating shaft 161, and the second metal cone 150 is disposed on the connecting shaft 162. The starter motor 160 makes the second metal cone 150 rotate through the rotating shaft 161 and the connecting shaft 162, and the starter motor 160 makes the second metal cone 150 move to be located between the first metal cone 140 and the ground plate 170. The low voltage end 180 is disposed behind the ground plate 170. In a preferred embodiment, the distance between the first metal cone 140 and the ground plate 170 needs to be maintained at a fixed value to avoid leakage.

In this embodiment, when the switch 120 is closed to turn on the capacitor 130 and the high voltage power supply 110, the high voltage power of high voltage power supply 130 charges the capacitor 130. The capacitor 130 stores the charge to a high voltage. When the voltage value of the capacitor 130 is higher than a certain value, the capacitor 130 discharges the first metal cone 140, so that the first metal cone 140 maintains at a high voltage corresponding to the high voltage power supply 110. The switch 120 is then open to cause an open circuit between the first metal cone 140 and the high voltage power supply 110. Therefore, the high voltage power supply 110 provides the periodic high voltage power through the closed state and the open state of the switch 120.

When the switch 120 is closed, the voltage of the first metal cone 140 will exceed a breakdown voltage of air, so that the induced charges of the second metal cone 150 are concentrated at a tip end. A strong electronic field will be generated between the first metal cone 140 and the ground plate 170 to discharge the tip end of the second metal cone 150 and make it to lose electric neutrality to generate an ionic wind.

The discharge of the tip end of the second metal cone 150 will release a large current, which causes the capacitor 130 to over discharge and enter a low voltage. At this time, the switch 120 will be closed again to turn on the high voltage power supply 110 and the capacitor 130, which allows the capacitor 130 to be recharged. The foregoing process is repeated to complete a cycle to generate a continuous ionic wind.

During the procedure of generating the ionic wind, the second metal cone 150 continuously rotates due to inertia. When the second metal cone 150 rotates (that is, when the second metal cone 150 is not located between the first metal cone 140 and the ground plate 170), the voltage between the first metal cone 140 and the ground plate 170 has a certain strength, but it is still insufficient to generate an electric field for corona discharge. Therefore, only when the second metal cone 150 is located between the first metal cone 140 and the ground plate 170, the tip end of the second metal cone 150 emits charges. However, since the second metal cone 150 continues to rotate, the discharged charges are also affected by the inertia of the rotation, wherein the received force is equivalent to the vector sum of inertia and Coulomb force. The low voltage end 180 disposed behind the ground plate 170 receives the charges emitted by the second metal cone 150. After the charges hit the neutral air, more ionic wind is generated, which effectively increases the wind speed of the ion wind generating device 100.

Moreover, in a preferred embodiment, the voltage value of the low voltage end 180 is a negative voltage. However, in some embodiments, as long as the voltage values of the high voltage power supply 110, the ground plate 170, and the low voltage end 180 are arranged in descending order, the low voltage end 180 can function to receive charges. The voltage value of the low voltage end 180 is not limited to a negative value. For example, the voltage value of the high voltage power supply 110 is 1000V, the voltage value of the ground plate 170 is 10V, and the voltage value of the low voltage end 180 is 0V; or the voltage value of the high voltage power supply 110 is 1000V, the voltage value of the ground plate 170 is 0V, and the voltage value of the low voltage end 180 is −50V; or the voltage value of the high voltage power supply 110 is −2000V, the voltage value of the ground plate 170 is −100V, and the voltage value of the low voltage end 180 is 100V. The above three arrangements can allow the low voltage end 180 to function to receive charges.

Figure 2:
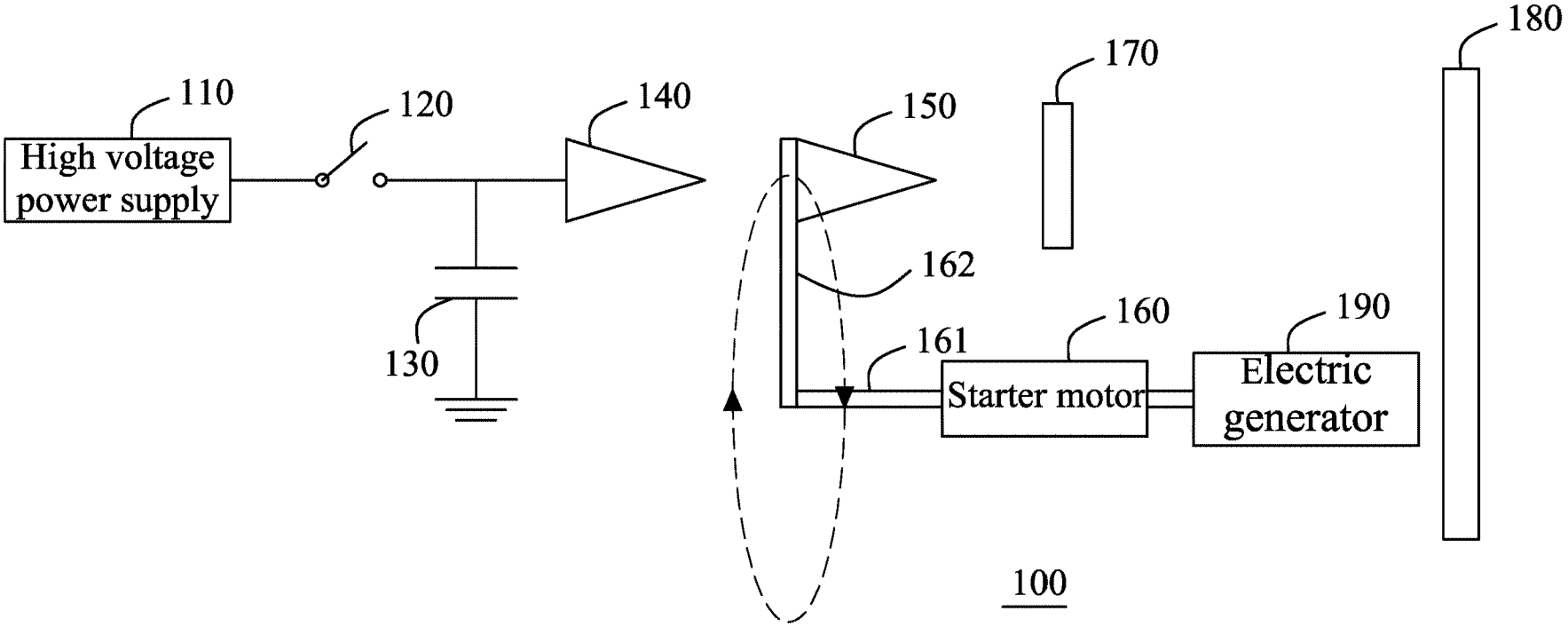
FIG. 2 is a schematic diagram of an ion wind generating device according to a second embodiment of the present invention.

Please refer to FIG. 2. FIG. 2 is a schematic diagram of an ion wind generating device according to a second embodiment of the present invention. In this embodiment, the ion wind generating device 100 further includes an electric generator 190. The electric generator 190 is coupled to the rotating shaft 161 of the starter motor 160. When the low power end 180 receives the charges released by the second metal cone 150 to generate more ionic wind, the ionic wind can also drive the connecting shaft 162 to rotate, and then the rotated connecting shaft 162 can rotate the electric generator 190 through the rotating shaft 161 to generate electric power, which further supplements the electric power of the ion wind generating device 100.

Figure 3:
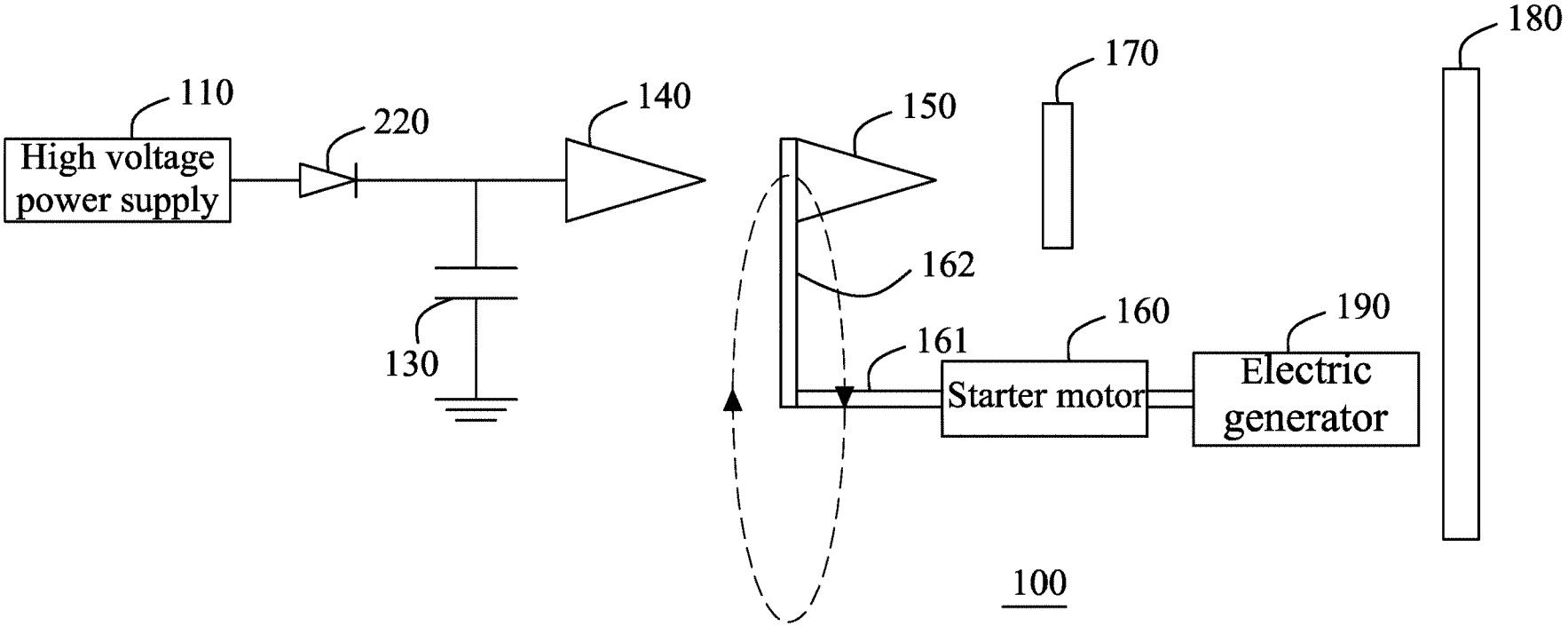
FIG. 3 is a schematic diagram of an ion wind generating device according to a first embodiment of the present invention.

Please refer to FIG. 3. FIG. 3 is a schematic diagram of an ion wind generating device according to a first embodiment of the present invention. In this embodiment, the ion wind generating device 100 uses a diode 220 to replace the switch 120, and the high voltage power supply 210 employs a high voltage coil. The high voltage power supply 210 periodically supplies the high voltage power to charge the capacitor 130, and the supply of the high voltage power employs pulse control. The high voltage power supply 210 uses the action of the pulse control to periodically charge the capacitor 130. That is to say, after the charging of the capacitor 130 is completed, the high voltage power supply 210 stops supplying the high voltage power, and the capacitor 130 discharges the first metal cone 140. The arrangement of the diode 220 prevents the high voltage power of the capacitor 130 from back flushing into the high voltage power supply 210.

The ion wind generating device 100 of the present invention achieves the purpose of producing ionic wind by using components such as the high voltage power supply 110, the capacitor 130, the first metal cone 140, the second metal cone 150 and a motor. Further, the electric generator 190 and the low voltage end 180 are used for receiving charges, which further increases the wind speed generated by the ion wind generating device 100. Moreover, the ion wind generating device 100 of the present invention can provide a larger wind speed as the thrust, which can be used as a thrust source of a small-sized lifting object. Therefore, traditional motor transmission mechanism can be replaced by the ion wind generating device 100 of the present invention, which has the advantages of small volume, simple structure, and no noise.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An ion wind generating device, comprising:

a high voltage power supply, for periodically providing a high voltage power;

a capacitor, connected in parallel to the high voltage power supply;

a first metal cone, connected in series to the high voltage power supply;

a ground plate, disposed on the same axis as the first metal cone;

a starter motor, comprising a rotating shaft and a connecting shaft, wherein the connecting shaft is perpendicular to the rotating shaft; and a second metal cone, disposed on the connecting shaft;

wherein after the starter motor makes the second metal cone move to be located between the first cone and the ground plate, the starter motor stops rotating;

wherein the high voltage power supply charges the capacitor with the high voltage power, and the capacitor discharges the first metal cone; and when the second metal cone is located between the first metal cone and the ground plate, the first metal cone causes the second metal cone to discharge to generate an ionic wind.

2. The ion wind generating device in claim 1, further comprising:

a diode, disposed between the first metal cone and the high voltage power supply.

3. The ion wind generating device in claim 1, wherein the high voltage power supply is a high voltage coil.

4. The ion wind generating device in claim 1, further comprising:

an electric generator, coupled to the rotating shaft of the starter motor.

5. The ion wind generating device in claim 1, further comprising:

a low voltage end, disposed behind the ground plate.

6. The ion wind generating device in claim 5, wherein the voltage values of the high voltage power supply, the ground plate and the low voltage end are arranged in descending order.

7. The ion wind generating device in claim 1, further comprising:

a switch, connected in series to the high voltage power supply, wherein the high voltage power supply supplies the periodic high voltage power through the switch.

8. The ion wind generating device in claim 1, further comprising:

a diode, connected in series to the high voltage power supply.

9. The ion wind generating device in claim 1, wherein the high voltage power supply supplies the periodic high voltage power by using pulse control.

* * * * *